United States Patent [19]

Langer et al.

[11] Patent Number: 4,497,191

[45] Date of Patent: Feb. 5, 1985

[54] PLANT AND PROCESS FOR HOT-ROLLING STRIP OR PLATE STOCK

[75] Inventors: Uwe Langer, Leonding; Franz Brettbacher, Linz, both of Austria

[73] Assignee: Voest-Alpine Aktiengesellschaft, Linz, Austria

[21] Appl. No.: 469,017

[22] Filed: Feb. 23, 1983

[30] Foreign Application Priority Data

Mar. 5, 1982 [AT] Austria ..... 869/82

[51] Int. Cl.[3] ..... B21B 41/02

[52] U.S. Cl. ..... 72/202; 72/229; 72/234

[58] Field of Search ..... 72/229, 231, 226, 227, 72/234, 366, 202, 200

[56] References Cited

U.S. PATENT DOCUMENTS

| | | | |
|---|---|---|---|
| 3,331,232 | 7/1967 | King | 72/227 X |
| 3,803,891 | 4/1974 | Smith . | |
| 4,308,739 | 5/1982 | Tippins | 72/229 |
| 4,348,882 | 9/1982 | Tippins | 72/202 |

FOREIGN PATENT DOCUMENTS

| | | | |
|---|---|---|---|
| 177747 | 8/1953 | Austria . | |
| 1162796 | 2/1964 | Fed. Rep. of Germany | 72/226 |
| 2539215 | 3/1976 | Fed. Rep. of Germany . | |
| 1132772 | 3/1957 | France . | |
| 2036621 | 7/1980 | United Kingdom . | |
| 2068281 | 8/1981 | United Kingdom . | |
| 0686787 | 10/1979 | U.S.S.R. | 72/231 |

*Primary Examiner*—Francis S. Husar
*Assistant Examiner*—Steven B. Katz
*Attorney, Agent, or Firm*—Kurt Kelman

[57] ABSTRACT

In a hot-rolling plant, a single roughing stand directly precedes a forward reversing coiler and is closely spaced therefrom. A set of two reversing finishing stands is arranged in direct succession between the forward reversing coiler and a rear reversing coiler, the distance between the roughing stand and the finishing stands being just sufficient to accommodate the forward reversing coiler. The set of finishing stands and the roughing stand are selectively operable individually and jointly with each other.

1 Claim, 2 Drawing Figures

PLANT AND PROCESS FOR HOT-ROLLING STRIP OR PLATE STOCK

Figure 1:
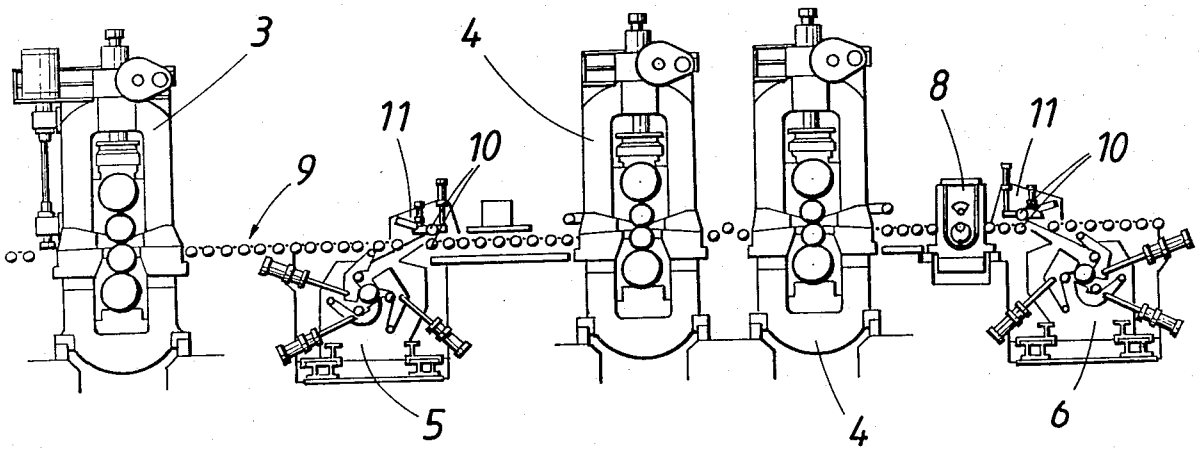

This invention relates to a plant and process for hot-rolling strip or plate stock, comprising two reversing rolling mill stands disposed in direct succession between forward and rear reversing coilers.

In hot-rolling plants comprising reversing rolling mill stands, it is desired to use different working rolls for the breaking-down passes and the finishing passes so that a breaking-down stand and a separate finishing stand are usually provided. In that practice, the surface roughness of the rolls and the diameter of the rolls can be selected in view of the requirements to be met by the shaping operation. A disadvantage involved in that practice resides in that the capacity of the breaking-down stand is only poorly utilized and that the transfer of the rolled stock from the breaking-down stand to the finishing stand and the large number of passes to be performed on the finishing stand inevitably involve a large temperature drop even if the finishing stand is preceded and succeeded by holding furnaces. Owing to that temperature drop, the stock can hardly be maintained at the required final rolling temperatures, particularly if thin strip is being hot-rolled and if the strip is to be wound to form heavy coils. Besides, the strip being rolled can be descaled only in one pass or in a few passes if high temperature drops are to be avoided although this practice will result in a poor surface finish of the strip. Moreover, the use of such hot-rolling plants imposes a lower limit on the thickness to which the strip can be rolled because the temperature drops are so large that the strip will have been cooled to the lowest permissible temperature when the strip has a thickness of about 2 mm. It will be understood that the capacity of such plants is restricted and is of an order of up to 450,000 metric tons per year.

It is known from French Patent Specification No. 1,132,772 that large temperature drops can be avoided if two or more rolling mill stands are arranged in direct succession so that the stock is rolled in both or all of the stands at the same time and the required number of passes can be reduced. But the use of reversing stands arranged in direct succession involves the disadvantage that the roll diameters and the surface roughness of the rolls cannot be selected in dependence on the requirements of the operation performed in each stand because the stands are similar.

It is an object of the invention to avoid the disadvantages explained hereinbefore and so to improve a hot-rolling plant of the kind described first hereinbefore that an economical production of thin hot strip which has a good surface finish and has been wound to form coils of heavy or medium weight can be ensured and that the capacity of the plant can be greatly increased.

This object is accomplished according to the invention with a forward reversing coiler which is directly preceded by a breaking-down stand, each rolling mill stand being selectively operable alone and jointly with at least one of the other stands.

It is not surprising that the provision of a preceding breaking-down stand will permit a selection of working rollers having such diameters and such surface roughnesses which will meet the requirements which depend on the shaping operations to be performed by the respective stands. But the arrangement according to the invention differs from the known arrangement of breaking-down stands in that the breaking down stand directly precedes the forward reversing coiler so that there is no need for a roller conveyor for conveying the strip between the breaking-down stand and the finishing stands. As a result, the temperature drop involved in the transfer of the strip from the breaking-down stand to the finishing stands will be avoided and all stands can be operated jointly. But because the breaking-down stand is succeeded by the finishing stands, the hot strip must be moved through the open nips between the rolls of the finishing stands when the breaking-down stand is operated alone.

As the breaking down stand directly precedes the forward reversing coiler, the strip can first be subjected to the desired breaking-down passes in the breaking-down stand and this can be succeeded by continuous passes in all three stands and finally by the finishing passes performed by the two reversing stands in a tandem operation so that the advantage is afforded that the temperature of the rolled stock will not drop below the lowest permissible final rolling temperature even when the stock is rolled to a thickness below 2 mm. The surface finish of the rolled stock will not be adversely affected by the breaking-down stand because the latter is succeeded by the two reversing stands, which constitute finishing stands, and the last passes can be performed by these finishing stands along. Because the stock can be reduced quickly, an adequate final rolling temperature will be ensured, the capacity of the plant can be greatly increased and the strip can be wound to form coils of heavy or medium weight.

The invention is illustrated by way of example on the drawing, in which

Figure 2:
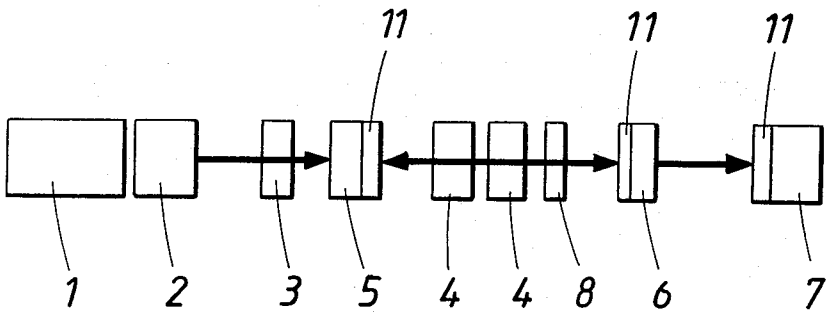

FIG. 1 is a diagrammatic side elevation showing a plant according to the invention for hot-rolling strip or plate stock and FIG. 2 is a block diagram illustrating a hot-rolling plant according to the invention.

In accordance with FIG. 2, the stock to be rolled is heated in a furnace 1 to the desired rolling temperature and is subsequently descaled in a descaling washer 2. It is then delivered to the rolling mill stands, which consist of a breaking-down stand 3 and two finishing stands 4. The latter consist of reversing stands. Two reversing coils 5 and 6 respectively precede and succeed the reversing stands 4. To avoid substantial temperature drops, each of the reversing coilers 5 and 6 may be provided with a heatable mandrel or with a heating hood. When the hot strip has been finish-rolled, it is wound on a coiler 7. Crop shears 8 for trimming the leading and trailing ends of the strip are provided between the rear reversing stand 4 and the rear reversing coiler 6. This arrangement of the crop shears 8 affords the important advantage that the strip can be additionally trimmed at its leading and trailing ends after the finishing passes.

As shown in FIG. 1, the stock is transferred in conventional manner on roller conveyors 9. Each of the coilers 5, 6 and 7 is preceded by driven pinch rollers 10 of a pinch roller unit 11.

The illustrated plant for hot-rolling strip or sheet plate stock differs from conventional hot-rolling plants of a similar kind mainly in that the breaking-down stand 3 precedes the two reversing stands 4, which serve as finishing stands, and is spaced from those stands by the smallest possible distance, which is just sufficient for the accommodation of the reversing coiler 5 between the breaking down stand 3 and the forward reversing stand 4. As a result, the roller conveyor otherwise needed for receiving the strip for the breaking-down passes is no longer required and an advantage is obtained which resides in that each stand can be selectively operated alone or jointly with at least one of the other stands. In other words, all three stands can be operated jointly or the two finishing stands can be operated in tandem. When breaking down passes in the required number have been performed on the breaking-down stand 3, the rolled stock can be reduced very quickly by the simultaneous operation of all three stands and/or by the tandem operation of the reversing stands 4 so that the heat losses can be minimized. A satisfactory surface finish of the rolled stock is ensured because the stands comprise a breaking-down stand and two finishing stands.

What is claimed is:

1. A hot-rolling process carried out in a hot-rolling plant comprising a forward reversing coiler, a rear reversing coiler, and a set of two reversing rolling mill finishing stands arranged in direct succession between said forward and rear reversing coilers, wherein stock to be rolled is rolled in a plurality of passes in the roll bites of said reversing stands and is coiled up on one of said coilers after at least one of said passes, wherein the improvement comprises the steps of subjecting said stock to at least one breaking-down pass in a single breaking-down rolling mill stand directly preceding said forward reversing coiler and closely spaced therefrom, maintaining said two reversing rolling mill stands inoperative by opening the roll bites thereof sufficiently while passing said stock freely therethrough during said breaking-down pass, subsequently operating all of said stands simultaneously to subject said stock to at least one combined breaking-down and finishing pass in said breaking-down stand and said reversing stands, respectively, coiling said stock in said rear coiler after at least one of said combined breaking-down and finishing passes, and subjecting said stock to at least one finishing pass in said two reversing stands after said combined breaking down and finishing pass, and coiling said stock in the other one of said coilers while maintaining said breaking down stand inoperative.

* * * * *